US005333870A

United States Patent [19]

Stevenson, Jr.

[11] Patent Number: 5,333,870

[45] Date of Patent: Aug. 2, 1994

[54] AIRBORNE OVERSPIN PUTTER IMPROVING BALL ACCURACY

[76] Inventor: Verne W. Stevenson, Jr., 2802 6th Ave., Rock Island, Ill. 61201

[21] Appl. No.: 2,793

[22] Filed: Jan. 11, 1993

[51] Int. Cl.[5] ..... A63B 53/04

[52] U.S. Cl. ..... 273/164.1; 273/169; 273/167 F

[58] Field of Search ..... 273/167 R-77 A, 273/164.1, 162 R, 187.4, 186.2, 193 R, 194 R, 194 A, 80.2, 79

[56] References Cited

U.S. PATENT DOCUMENTS

| | | | |
|---|---|---|---|
| Re. 19,178 | 5/1934 | Spiker | 273/169 |
| D. 246,329 | 11/1977 | Little | 273/164.1 |
| 1,046,343 | 12/1912 | Smith | 273/164.1 |
| 1,543,691 | 6/1925 | Beat | 273/167 F |
| 2,174,212 | 9/1939 | Newsome | 273/164.1 |
| 2,954,231 | 9/1960 | MacIntyre | 273/164.1 |
| 2,957,696 | 10/1960 | Warpotas | 273/164.1 |
| 4,077,633 | 3/1978 | Studen | 273/164.1 |
| 4,795,157 | 1/1989 | Bencriscutto | 273/164.1 |
| 4,795,158 | 1/1989 | Kuykendall | 273/167 B |
| 4,995,612 | 2/1991 | Finney | 273/167 F X |
| 5,133,555 | 7/1992 | Bailey | 273/164.1 |
| 5,167,414 | 12/1992 | Montgomery | 273/164.1 |

FOREIGN PATENT DOCUMENTS 455748 10/1936 United Kingdom ..... 273/169

OTHER PUBLICATIONS

"Golf World" Magazine, Jul. 2, 1976 Issue, p. 31.

*Primary Examiner*—V. Millin
*Assistant Examiner*—Sebastiano Passaniti

[57] ABSTRACT

Weight is moved essentially in three different directions within the putter head causing the center of percussion (CP) to be uniquely relocated to create overspin and no sidespin. Other related changes to head shape, face loft, shaft location and positioning of alignment mark cooperate with the above to significantly improve accuracy. The basic shape of the putter head is much revised but looks conventional since the changes are hidden under the top surface as seen by the person positioned to putt. The backspin normally expected from positive loft is eliminated and replaced with the more accurate airborne overspin. Sidespin is also eliminated, resulting in a truly straight forward turning ball that, compared to commercial putters, lifts less, covers less distance to first bounce, and gently touches down already turning in the direction hit. The ball is much quicker to settle down to a fully rolling condition against the turf. Present invention tests prove it to be at least 2 to 4 times more accurate. Present putter meets the United States Golf Association Rules of Golf.

6 Claims, 2 Drawing Sheets

AIRBORNE OVERSPIN PUTTER IMPROVING BALL ACCURACY

BACKGROUND OF THE INVENTION

1. Field of Invention

The present invention relates in general to golf clubs and in particular to golf putters, even more specifically to putter heads.

2. General

This general section is added to introduce the method used to study commercial putters manufactured by major golf companies and my test golf putters. The point being that all that is written here is not based on theory alone, but mainly on actual test data.

Earlier in my program, while using test putters and practicing with them, I was convinced that I had truly obtained overspin. The trouble was neither I or anyone else could see it with the naked eye. Simply stated, I couldn't prove it.

I then designed and fabricated what I call a "mechanical iron man putting system." The purpose of which was to:

a. Assure that the putter being tested struck the ball with the putter head going perfectly straight.

b. That the putter would be securely held by the grip and could be adjusted to set up the putter to assure it was positioned:

(1) Exactly perpendicular to the ground.

(2) Exactly to its built-in lie position.

(3) Exactly to its built-in loft position.

(4) 1/16 of an inch off of the turf.

(5) With a pivot point at a height as close as possible to that normally used by the average golfer. Putters are not pivoted at the top of the grip. The lower torso and head are not moved whereas the putter, hands, arms, and shoulders move in unison. This places the pivot point just below the putter's (person's) shoulders. Approximately 9 or 10 inches above the top of the putter grip.

c. Control the swingspeed of each putt so that exact data could be collected for the performance of each putter. This was accomplished using a dial indicator to control the length of the backward movement (backswing) before releasing the putter.

The putter system consisted of a 4 leg system supporting a shaft held parallel to the putting surface.

The shaft is supported by two bearing blocks and powered by two torsional springs.

Every effort was made to assure that each putter tested was indeed fairly tested and accurately recorded.

A large tube was suspended from the shaft and contained six thumb screws to secure the grip inside the tube. This allowed exact positioning of the putter to accommodate loft, lie, etc.

During testing of each putter, a camcorder was used to record the movements of the ball during the first 36 inches of ball travel. With the camcorder set at 1/1000 second shutter speed and other technical considerations, a frame by frame stop action review of each putt could be recorded and studied.

With this added capability, the design of the putter in question could be precisely controlled to obtain the ideal relationship between movement of the center of percussion and the amount of loft. These relationships are dependent upon such other factors as size, length heel to toe, shaft location, material used for manufacture and height of the face. Initial tests using extra weight above the centerline resulted in a no-spin instead of overspin. That is, the ball would neither spin forward or backward upon being hit. This is a much more desired condition since it too results in improved performance. However, with further research work, overspin was achieved. For the first time in the history of golf, airborne overspin was accomplished and recorded. The myth that so little velocity is generated when putting that there is little or no effect on ball spin has been suppressed forever. Tests prove that even a simple six (6) foot putt can spin the ball backward or sideways and now forward. We should have known this when professional golfers would claim that they hooked their putts just like their drives.

3. Description of Related Art

A golf putter consists of a shaft with a grip at the uppermost end and a head secured to the lower end of the shaft. The putter head has a flat face that is used for striking the golf ball for the purpose of moving it across the golf green in an attempt to have it fall into a 4¼ inch hole.

The individual doing the putting is faced with several problems to be solved in order to hit the ball accurately enough to have the ball either fall into the golf hole or the ball end up close enough so that the ball can be holed out on the next putt.

The putting individual believes that aligning the putter in the correct direction and hitting the ball at the right speed will overcome; the slant of the green, the turf (fast or slow) and the distance to be covered. Unfortunately, if every technical manipulation of the putter is performed perfectly the ball is not likely to hit the targeted hole. This does not happen because the operator made a mistake, it is because golf putters today have built-in inaccuracies. The putter will not move the ball accurately in the direction aimed. The inaccuracies are greater than might be expected.

In one set of putting tests performed using a mechanically accurate putting machine, the dispersion of the ball for 24 ft. putts was 25½ inches wide. The positions where the balls terminated were well scattered. That is a dispersion of six (6) times the size of the hole (4¼ inches diameter). A betting man would say that the odds are 5 to 1 against hitting the hole.

Nearly 100% of the putters today have positive loft of from 2 to 8 degrees. Positive loft in present day putters creates backspin. Approximately half of these putters have the alignment mark misaligned with the center of percussion (CP) of the putter head. This causes sidespin.

Backspin and sidespin are built-in inaccuracies helping to make putting one of today's most difficult procedures in golf. Because putting strokes account for approximately 40 percent of a golfers total score per round (18 holes), it is one of the most important aspects of golf.

There are putters with (0) zero degrees of loft. These will either slide the ball against the turf or pinch the ball against the turf immediately upon being struck.

Mallet head putters, blade type putters, and "L" shaped putters (looking from heel to toe) with positive loft will cause the ball to lift and backspin.

"L" shaped putters that have extra weight across the bottom of the putter, usually has the weight equally divided between the toe and heel. Heel and toe weighting is primarily located across the bottom along the sole of the putter. These putters will lift even more and backspin even more.

Reference is made to Great Britain Patent Number 7550. This patent depicts eleven (11) different ways to cause the ball to be pinched against the turf to attain a different kind of overspin. This invention has negative loft.

U.S. Pat. No. 3,333,854 also covers a putter that pinches the ball against the turf. This one, however, depends on the sharp corner of two right angles forming the face. If missing the ball with the upper sharp edge the lower sharp edge will allegedly take over and the ball will be thus pinched against the turf by the second sharp edge.

U.S. Pat. No. 258,377 is an inverted " L"shaped putter. The drawings definitely depict the face with zero (0) or no loft. I would be convinced that the putter would either slide or pinch the ball against the turf. I'm strictly using the what you see is what you get approach when an ornamental design patent is involved. If, however, positive loft were allowed, this putter would backspin in the same manner as other positively lofted putters mentioned above.

The advantages of airborne overspin over the above present day or previously patented putters shall be obvious as set forth herein.

To sum up, putters today cause the ball to either slide, be pinched against the turf, or lift and backspin.

All of these ball reactions are caused by built-in design flaws creating inaccuracies. The pinching putters are understandably not being produced. At least there seems to be none on the shelf for sale and none advertised.

Positive loft is required to lift the golf ball above the golf green turf grasses. Years ago golf greens were cut higher requiring greater positive loft. Positive loft of as much as 13 degrees was not unusual. Today golf green turf grasses, primarily due to better grasses, and other chemical advancements, are cut very short indeed. The results are golf greens that cause the ball to roll very fast. The point being that less positive loft is required today. However, golf putters still have positive loft of up to 8 degrees. Most are from 4 to 8 degrees.

Positive loft in present day putters creates backspin. 90 to 95% of present day putters have extra weight across the bottom usually equally divided between the heel and the toe. This causes the ball to lift even higher and backspin more. The distance to first bounce is increased.

A backspinning ball kicks-up or pops-up at first bounce in its attempt to reverse backspin and start to turn forward in the direction hit. Sometimes the kick-up causes the ball to jump higher than the height of the flight to first bounce. A backspinning ball creates perfect conditions for an erratic unpredictable directional and distance performance. At first bounce the irregularities of the turf under the first bounce area will cause the ball to perform an unsurmountable number of ball reactions, none of which help to predict the resulting direction or distance. The second and third and even fourth bounce can be similarly negatively effected by the balls inability to quickly settle down to a more predictable, more accurate, full rolling condition against the turf. All golf putters that cause the ball to backspin have what I call "built-in inaccuracies."

About 50% of the putters on the market today have the alignment mark usually centered on top of the putter head misaligned with the center of percussion (CP) of the head. The ball sidespins when the putter head hits the ball misaligned with the CP of the head. The worst condition is when the shaft is located in the heel of the putter head and the alignment mark is centered heel to toe. The misalignment can be as much as ¾inch. Under these conditions the sidespin in so bad that during review of frame by frame stop action video of the ball's performance it was difficult to record the results. Such things as distance to first full turn and first bounce was made more difficult especially when mixed with backspin.

When the inaccuracies of backspin are mixed with the inaccuracies of sidespin, each bounce becomes a totally unpredictable dispersible event that no amount of practice can overcome.

One objective of the present patent is to provide a putter that eliminates built-in backspin and sidespin.

Another object is to replace backspin with built-in airborne overspin.

A further object is to assure the alignment mark is located directly over the center of percussion (CP) of the putter head. This assures the ball can be accurately aligned with the alignment mark and that sidespin or twist of the ball will not occur, human error not included.

Another object is to have change and effect result in building-in greater accuracy.

Another object is to minimize the amount of practice required to become a good putter. Because the above built-in inaccuracies have been replaced by building-in test proven accuracy, the directional dispersion of the ball has been significantly reduced. During the same putting tests described above where two (2) commercial putters dispersed 25½ inches, the present patent test putter dispersed the ball 6 inches. The hole being 4¼ inch diameter, a betting man would say that the odds are two to one for (not against) hitting the hole. That's ten times more accurate. This inventor only claims to be two to four times more accurate since not all putters have six (6) or seven (7) degrees of loft and extra weight spread across the sole of the putter.

The overall main objective is to ultimately assure that any individual golfer; beginner, high handicapper, amateur or professional can be expected to putt more accurately using the present invention.

SUMMARY OF THE INVENTION

In fulfillment and implementation of the previously recited objects the following primary means were employed:

a. The center of percussion (CP) was uniquely relocated using a new putter head shape and unique weight changes. The shape worked to assist in a strong movement of weight upwardly and forwardly into the apex of the right angle formed by the vertical face and the horizontal top surface. Other weight changes in the head combined with the shaft location also centered the CP between the heel and toe. This provides for proper positioning of the alignment mark directly over the CP of the head, thus eliminating sidespin.

b. The positive loft is also precisely controlled to be uniquely commensurate with the ability of the head's CP to influence the ball's spin characteristics directly upon being struck by the putter's positively lofted face.

It will therefore be appreciated that by virtue of these unique weight arrangements and precise controls that the ball's normal backspin is replaced with airborne overspin and no sidespin immediately upon impact with the positively lofted face. The ball will lift off the turf, and overspin with no sidespin all the way to the first bounce.

The individual doing the putting needs only to maintain the putter in a vertical mode to maintain the built-in loft and hit the ball on the alignment mark to reap the benefits of greater accuracy created by built-in airborne overspin and no sidespin.

The present patent is test proven to be Two (2) to four (4) times more accurate compared to putters on the market today.

It is believed that the distribution of weight being increasingly heavier forwardly and upwardly results in enough weight being located above the CP of the ball at impact that tangential velocity above the CP of the ball creates airborne overspin.

The following are test proven results from reviewing frame by frame stop action video of ten (10) commercial golf putters and my pilot model airborne overspin putters: (These tests were conducted using a dial indicated mechanical putting machine.)

a. The pilot model creates overspin instead of backspin.

b. The pilot model creates no sidespin, many of the commercial putters have alignment mark misaligned with the CP of the said head creating built-in sidespin.

c. The pilot model causes the ball to travel approximately one half (½) the distance to first bounce.

d. The pilot model causes the ball to lift one quarter (¼) the height to first bounce.

e. At first bounce the ball touches down gently turning in the direction hit compared to a backspinning ball hitting the turf and kicking upwardly in its attempt to start the ball turning in the direction hit.

f. During 24 foot putts (first 36 inches) the ball turned two complete turns forward, the ten (10) commercial putters could not turn the ball forward more than ½ turn.

The following is a play by play description of the golf ball's performance using an airborne overspin putter on a 24 ft. putt. The ball leaves the putter head and immediately lifts off the turf with the ball slowly turning in the direction hit. It rises to about 3/16 inch during its eleven inch airborne trip to the first bounce. The first contact with the turf is more like a lightly touching down or skimming against the turf, not really a bounce as most of us think of it. At the first touch down the ball immediately turns forward faster (overspins more) hardly lifting off the turf during the short three inch airborne scoot to the second touch down. At this point the ball again accelerates its overspin ratio to match the turf distance being covered creating a ball that's fully rolling against the turf. If there is to be any deviations in direction and distance caused by irregularities of the turf at each touch down they will be reducibly effected for three logical reasons; one: the ball is already turning in the direction turf contact will cause it to turn thus reducing resistance needed to accelerate the turning speed. Two: the ball touches down about ½ the number of times. Three: each impact with the turf is proportionally reduced by the fact that the height of flight is ¼ that of the average commercial putters and ½ the distance to first and second bounce.

BRIEF DESCRIPTION OF THE DRAWINGS

Refer now to FIG. 1 which is an isometric view of a preferred embodiment of the invention.

DETAILED DESCRIPTION OF THE INVENTION

Figure 1:
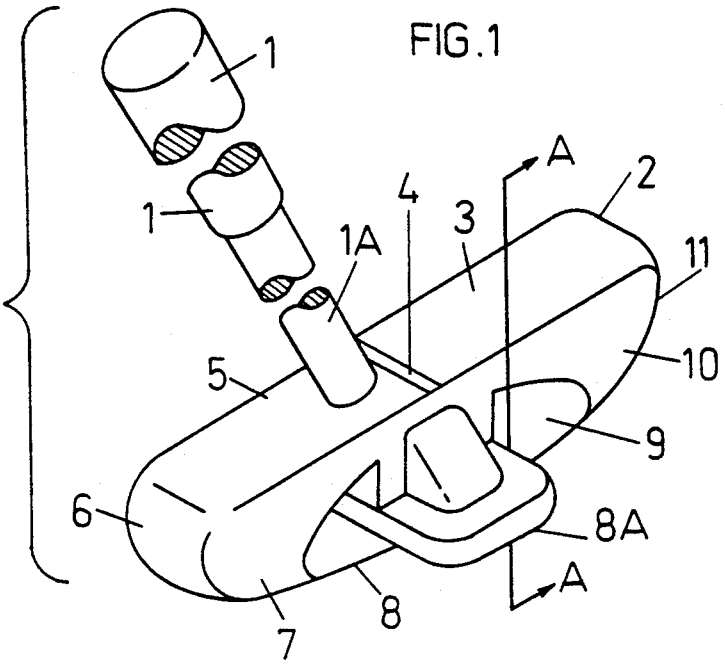

With reference now to the figures wherein like numbers refer to the same item or area throughout the figures. FIG. 1 is an isometric view of a preferred embodiment. Shaft 1A can be of a conventional short, medium or elongated shaft and made from any of the conventional materials. Grip 1 can also be conventional and will be located conventionally upward at the top of shaft 1A. Shaft 1A will be firmly secured at the bottom end to the top surface 3 of the putter head 2. The shaft is located about 3/16 to ½ inch off center (heel 6 to toe 11) toward the heel 6. The head 2 will weigh about eleven (11) ounces with a short shaft, about 12 to 13 ounces with a medium shaft and about 15 to 16 ounces with an elongated shaft. The head 2 can be made of any one of or a combination of several materials weighing different pounds per cubic foot. The pilot model putters used for testing the performance of the present invention were made of brass. A wooden pattern was first carved into the putter head shape design. Most patterns used for making rough sand castings are made from mahogany. Then a mold is made using the wooden pattern, the wooden pattern is removed and molten metal is poured into the void in the mold thereby taking the shape of the removed wooden pattern. After cooling, the mold is knocked away revealing a rough metal casting of a putter head in the shape of the wooden pattern. To remove the pattern from the mold the pattern must be slanted on all sides to allow the pattern to be slid or pulled out of the mold. The slanted sides are called a draft and is usually one to three degrees of slant. If the sides are straight removing the pattern from the mold would pull the packed sand loose along the sides and thereby destroy the mold each and every time. The head is then sanded into its final configuration. This is only one of the ways a putter head can be fabricated. The present invention was fabricated using this method. The heads 2 of the test models of the present invention were about 4 to 4 ½ inches long (heel 6 to toe 11), about 7/8 to ⅞ inches face 5 height with top surface varying from about 13/16 to one inch from face 5 to backside 12. The best known shape of head 2 forms a right triangle as viewed from heel 6 toward toe 11, especially when head 2 composed of only one material throughout. For reference purposes said face is lying substantially in a vertical plane, (less the positive loft of face 5.) Face 5 being the vertical leg, the top surface 3 being horizontal and being at right angle to said face 5. Loft is at least one (1) degree. The loft of the test models of the present invention were two (2) degrees. Two (2) degrees of loft creates sufficient lift to clear the turf grass during the golf ball's flight to first bounce. The backside 12 completes the right triangle by forming the diagonal side of the right triangle. The backside 12 is slanted backwards at the top. The top of the triangle connects to the rearmost portion of the top surface 3 and the bottom end connects to the sole 8 of face 5. The diagonal angle of backside 12 is from 35 to 70 degrees from the vertical plane of face 5 when right triangular shape being employed.

The right triangular shape as viewed from heel 6 toward toe 11 as heretofore described creates a perfect shape for distributing increasingly heavier weight simultaneously in two directions at right angles to each other, i.e. increasingly heavier weight forwardly toward face 5 and increasingly heavier weight upwardly toward top surface 3 of head 2, said right triangular shape specifically selected as a means for distributing weight when only a single material is involved.

This assists in moving the CP of the putter head as far as practicable into the apex of the right angle formed by face 5 and top surface 3. The unique distribution as described also results in an unusual amount of weight being distributed all across the top area of head 2 immediately adjacent to top surface 3. It is believed that the unique weight distribution characteristics of the right triangular shape contributes significantly to the ability of the putter to create airborne overspin.

Figure 2:
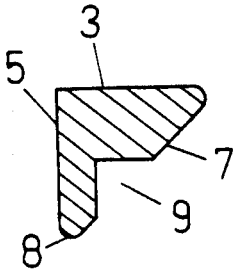
FIG. 2 is a cross sectional view of A—A in FIG. 1 through the putter head showing where material is removed.

The diagonal angle of backside 12 may be of various shapes: bulged, concave, or otherwise and will sometimes effect the shape of the backside of top surface 3. Attention is invited to alignment mark 4 and its location just forward of shaft 1A toward toe 11. Earlier it was mentioned that shaft 1A was located a little off center (heel 6 to 11) toward heel 6 (Repeat 3/16 to ½ inch). The shaft being moved enough to make room for alignment mark 4. This shaft movement will also move the center of percussion (CP) of the putter head 2 toward the heel 6 but not as far as the shaft 1A was moved. Three general areas; heel area 7, toe area 10 and area 9 will be covered after brief remarks to assure a complete understanding. In this invention the center of percussion (CP) is being moved into a position that is primarily responsible for overcoming backspin and in this discussion assuring that sidespin is no longer built-in by an alignment mark 4 being misaligned with the CP of putter head 2. The CP is the point at which if a moving body encounters an immovable obstacle, the motion would be arrested without producing any strain on the axis. For this putter application, it can be more simply stated: the CP inside the putter head when striking through the center of gravity (CG) of the golf ball will result in zero or no twist of the putter head 2 around shaft 1A. The CP in this case is commonly referred to as the "sweet spot." Looking at this from the golf ball side of the physical reaction, the ball will not twist or sidespin when similarly hit in line with the alignment mark, provided of course the alignment mark 4 is positioned directly over the CP in the head 2. Referring now back to areas 7, 10 and 9. Area 9 depicts where weight is removed generally along the bottom of backside area 12. The cross sectional view of A—A in FIG. 1 is shown in FIG. 2 with area 9 shown in FIG. 1 and 2. It can be seen that area 9 FIG. 1 has more material (weight) removed from the heel area 7 and less material (weight) removed from the toe area 10. This naturally results in more toe area 10 weight and less heel area 7 weight. Zero to one and one half (1½) times more weight being contained in toe area 10 compared to heel area 7. This will move the CP back a little toward the toe 11 whereby the alignment mark 4 can be located directly over the CP of the head and be located on the toe side of shaft 1A. This assures the alignment mark 4 can be easily seen and aligned with the center of the ball. A percussion test must be made against the face, as often as necessary to ascertain at what exact location on face 5 results in no twisting of the heel 6 or toe 11 around said shaft. The alignment mark 4 will be located exactly directly over that location which is the CP of the putter head 2. The ball will not sidespin or twist except when the individual hits the ball off center of the alignment mark 4.

All these little movements and changes to shaft 1A, weight toward toe and alignment mark location creates another built-in accuracy advantage. When the alignment mark 4 is positioned directly over the CP the unequal extra weight toward the toe 11 is neutralized, that is to say, the weight is now equally divided on either side of the alignment mark 4 thus creating equal heel and toe weighting. Better accuracy with less sidespin can be expected even when the ball is hit off center of alignment mark 4. Wider sole 8A is securely fastened to backside 12 approximately centered between heel 6 and toe 11. The bottom portion of wider sole 8A being in line with the bottom of narrow sole 8 providing a wider sole to stabilize the putter at address. Wider sole 8A being as light in weight as lightest weight material of head 2. Wider sole 8A is limited to no more than two (2) inches long when measured from the toe 11 end toward heel 6 end. Wider sole 8A is narrower than the width of top surface 3 and not being visible by putter operator.

For later reference notice in FIG. 2 how area 9 previously described is located below the centerline of head 2 between top surface 3 and sole 8. The reason is forthcoming during description of FIGS. 3 through 6.

Figure 3:
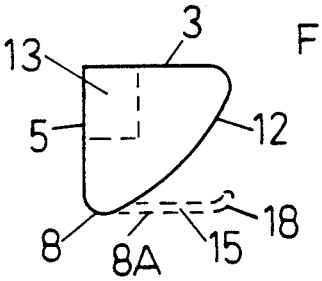
FIG. 3, 4, 5, and 6 are views looking from the heel to the toe, showing backside shapes, a rectangular cross sectional area shown in dotted lines, and ideas for a wider sole across the bottom also shown in dotted lines.
Figure 4:
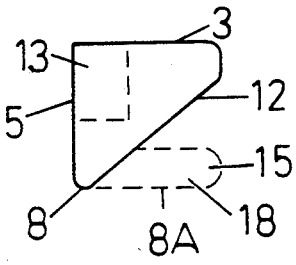
Figure 5:
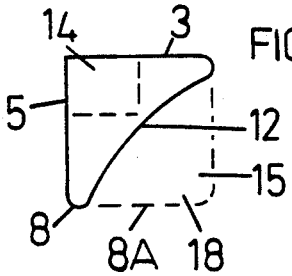
Figure 6:
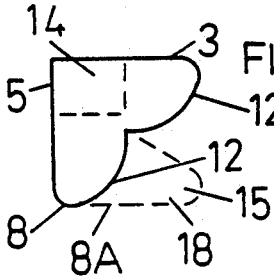

FIG. 3 and 4 depicts locations of a rectangular cross sectional area 13. FIGS. 5 and 6 depicts a rectangular cross sectional area 14. Area 13 is narrower across the top surface 3 and area 14 is narrower across face 5. Note that these rectangles are located into the apex of the right angle formed by face 5 and top surface 3. The dimensional characteristics of these rectangles are established by one half (½) the height of face 5 and one half of depth of top surface 3. The two opposite sides of the rectangle are naturally the same size as described for the other two sides. The different sizes of the rectangle is determined by the angle of backside 12 (repeat 35 to 70 degrees). Rectangle 13 will be narrower along top surface 3 when backside 12 is less than 45 degrees to the vertical plane of face 5. Rectangle 14 will be narrower along face 5 when backside 12 is greater than 45 degrees to the vertical plane of face 5. Only when backside 12 is substantially 45 degrees will the rectangular area become a square area. Hereinafter this area will be referred to as the rectangular cross sectional area. This rectangular cross sectional area 13 and 14 will be 100% filled with material from heel 6 to toe 11. Weight of this material will be at least equal to the weight per cubic foot of material used in the remainder of head 2. The rectangular cross sectional area will contain at least forty (40) percent of the total weight of the entire head. Exception is made for the hole needed to secure shaft 1A into top surface 3.

Referring back to FIG. 1 and FIG. 2 it can now be noted that area 9 being located below the centerline of head 2 between top surface 3 and sole 8 is indeed located below and not interfering with the rectangular cross sectional areas 13 and 14 as just described and defined. Material missing (by design prior to fabrication) in area 9 from backside 10 between heel 6 and toe 11 establishes the differential and extent of heel/toe weighing of heel 6 and toe 11. Generally material missing in area 9 from backside 10 will be adjacent to but not interfering with rectangular cross sectional area 13 and 14. Method and manner used for location of missing material in area 9 will effect thickness and general configuration of wider sole 8A from top to bottom. Length and width of wider sole 8A remaining as described above.

FIG. 3 through 6 depicts area 15 in four illustrative shapes (dotted lines) to provide a wider sole 8 across the bottom of head 2. This keeping said putter from leaning backward at the grip end when golf operator is preparing to putt with only one hand. Additional views of the wider sole are shown in FIG. 1 and FIG. 12 as wider Sole 8A. Material 18 used for this purpose will be at least as low in weight per cubic foot compared to the weight contained in other areas of head 2. Said added weight creates no negative effect on the 40% requirement for the rectangular cross sectional area. Also depicted are four illustrative shapes for backside 12. Said backside 12 being of various shape will occasionally effect the shape of the backside of top surface 3.

The rectangular cross sectional area just described is established for the purpose of moving the CP upward and forward into the apex of the right angle formed by face 5 and top surface 3. This is believed to contribute to the elimination of backspin normally expected from positive loft and replacing same with airborne overspin.

Figure 7:
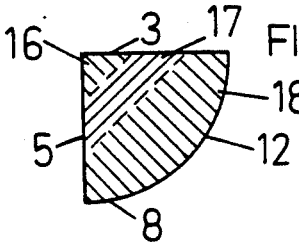
FIG. 7, 8, 9, and 10 depict a simplified cross sectional shape looking from the heel toward the toe depicting four different ways to distribute dissimilar weighting.
Figure 8:
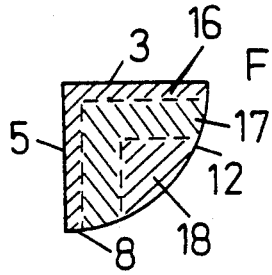
Figure 9:
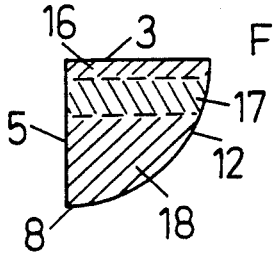
Figure 10:
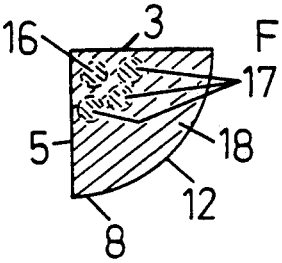

FIG. 7 through 10 depicts four simple cross sectional views as viewed from heel 6 to toe 11. These views depict 4 illustrative ways that dissimilar materials may be employed to provide improved management of weight distribution. Present invention will be made from at least one material. Area 16 has the highest weight per cubic foot, area 18 has the lowest and area 17 falls between the weight per cubic foot of area 16 and 18. FIGS. 7, 8 and 9 are self explanatory except that FIG. 9 distributes weight increasingly upwardly only. FIG. 10 depicts a complete head made from material with low weight per cubic foot being used to accommodate heavier weights being placed in drilled holes. Holes could be clear through from heel 6 to toe 11. Other methods of creating and filling voids may be used. These illustrations should not be construed as limiting the number of materials.

Figure 11:
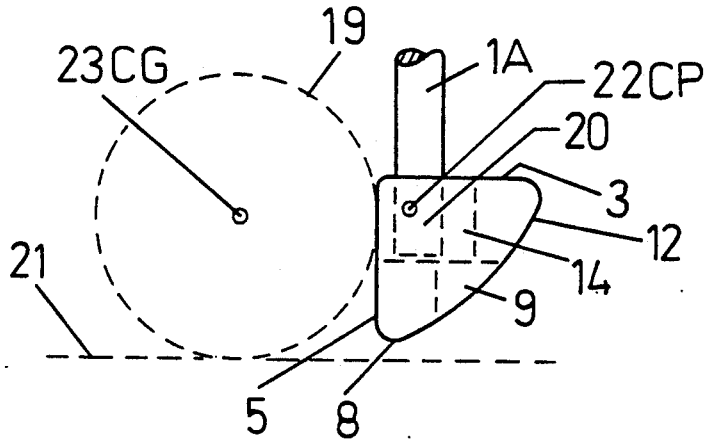
FIG. 11 shows the head and shaft of the putter looking from the heel toward the toe with the putter face touching the golf ball representing the impact position. The center of percussion in the head, the center of gravity of the ball and the turf line are also shown.
Figure 12A:
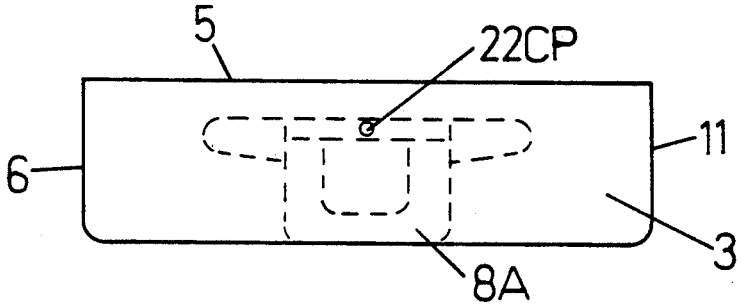
FIG. 12 shows four elevation views; top, rear, bottom and side, showing the relative location of the center of percussion, wider sole, and vertical and horizontal centerline.
Figure 12B:
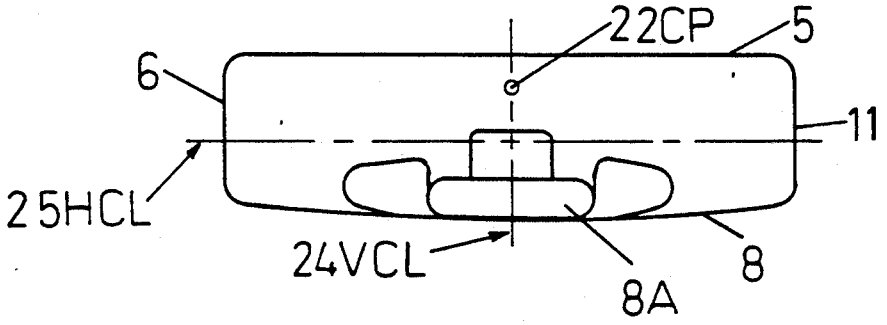
Figure 12C:
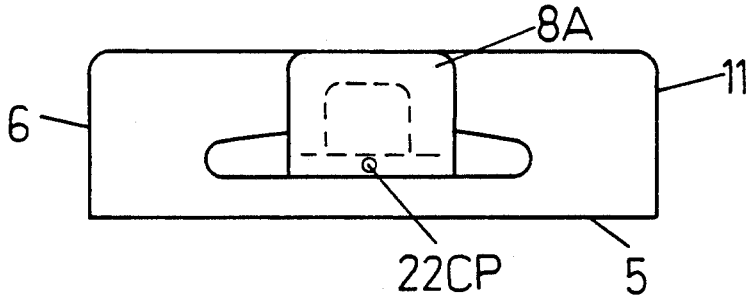
Figure 12D:
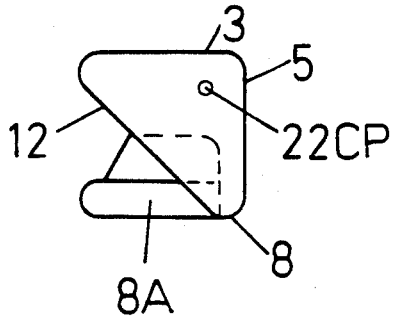

FIG. 11 shows a typical airborne overspin putter head with face 5 in contact with the curved circumference of a conventional golf ball 19. 22CP represents the relative position of the center of percussion (CP) of the putter head. Additional locational data for CP 22CP is shown in FIG. 12. 23CG represents the center of gravity (CG) for the golf ball. The 2 degrees of positive loft causes the face 5 to contact the curve of the ball less than (0.03125) 1/32 inch below the center of gravity (CG) 23CG of the ball, actually, 0.0292 inch below. FIG. 11 also shows the area 20 supporting the shaft 1A, area 14 covered in FIGS. 5 and 6, area 9 covered in FIGS. 1 and 2, and the golf green turf 21. Comment: FIG. 11 and the 0.0292 dimension covering where face 5 contacts ball 19 below the ball's CG is shown and mentioned to mentally register a relationship between the contact point and the amount of weight in head 2 that is above the CG of the ball at impact. FIGS. 12(*a*), 12(*b*), 12(*c*) and 12(*d*) show four views of the relative location of the center of percussion 22CP and the wider sole 8A. 24VCL is relative position of vertical centerline and 25HCL, is relative position of horizontal centerline. The center of percussion 22CP is shown in its relative location in all 4 views.

Based on video studies one (1) degree of loft is borderline. Two (2) degrees, however, provides adequate height of flight to overcome golf green turf grasses, especially with the shorter cut, faster greens of today.

It's believed to be somewhat like adding extra weight to the toe of a fairway or driving wood and placing it forward close to the face. This will cause the ball to sidespin counter-clockwise causing the ball to draw or hook (right handed club). This will happen even when the ball is struck on the center of the clubface (heel to toe).

In the case for the present invention the extra weight is upward and forward and believed to work in the same way.

Anyway, the amazing thing about all this inventive effort is not so much the accomplishment of overspin but the tremendous improvement in accuracy. Tests prove at least two to four times more accurate.

What I know for sure is that I kept adding more and more weight upward toward the top surface and forward toward the face until airborne overspin was achieved.

Regarding actual use of the present invention, it is required that the person putting keep the shaft 1A in the vertical position. If the putter shaft 1A is hooded (slanting grip end toward target) the two (2) degrees of loft can be reduced or eliminated. This would cause reduced loft, reduced height of flight and reduced overspin, negative loft could also result in pinching the ball against the turf causing overspin of another kind. After playing many games of golf I find this to be a simple task but it's importance should not be underestimated.

To improve the scope of the invention the following are included:

a. The rectangular cross sectional area may be invaded by means creating voids, thereby causing less weight and mass, at least one void providing a hole for shaft 1A and other voids such as holes from heel 6 to toe 11 being used to reduce percentage of weight below the CG of the golf ball at impact, whereas weight remaining in this area creates no negative effect on airborne overspin, and the forty (40) percent of the total weight limit is maintained. This alternative alters only the 100% fill requirement.

b. A difference can exist between the ratio of increasingly heavier weight upwardly toward top surface 3 when compared to the weight ratio of the increasing heavier weight being located forwardly toward face 5. The ratio of increasingly heavier weight upwardly will be at least equal to the ratio of the increasingly heavier weight forward.

This will serve to summarize the foregoing description and briefly indicate how the objects of the invention covered in the "Background of the Invention" have been met.

a. Backspin normally expected from positive loft was eliminated by severely changing the CP of the putter head upwardly and forwardly into the apex of the right angle formed by face 5 and top surface 3 of head 2.

b. Backspin was replaced with airborne overspin of the ball which will occur immediately upon impact with the ball. The ball will overspin all the way to the first bounce.

c. The alignment mark is located directly over the CP of the putter head. It is easily seen and can be easily positioned on the center of the ball. Discounting human error of alignment, the ball will not sidespin or twist upon impact.

d. The object of greater ball accuracy was decisively achieved and test proven using a mechanical putting machine on well manicured golf greens. Two commercial putters tested using 24 foot putts had a directional dispersion of 25½ inches. A betting man would say "that chances are five (5) to one (1) against hitting the hole." Using the same putting machine, the same balls on the same green and with the same clubhead speed the airborne overspin putter (with no sidespin) had a directional dispersion of six (6) inches. The betting man would say "two to one for hitting the hole." As is known the hole is 4¼ inches to diameter. I personally only claim two (2) to four (4) times more accuracy simply because not all putters will have as much loft and added weight across the sole area as the commercial putters used for the tests.

e. The object of reducing to an absolute minimum the amount of practice required to be a good putter is realized. With the airborne overspin (no sidespin) putters no practice is required to overcome built-in inaccuracies such as backspin and sidespin. Practice will be required only for the purposes of getting clubhead squared, hitting the ball in the direction desired, and hitting the ball with enough energy to reach and enter the golf hole.

f. And the final and most important object is assured by the above objectives being met. "Any individual, beginner, high handicapper, amateur or professional can be expected to putt more accurately with the present invention."

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but by the claims appended hereto.

What is claimed is:

1. A golf putter comprising a shaft, a grip being positioned to an uppermost portion of said shaft and a putter head securely affixed to a lowermost portion of said shaft, said putter head comprising a face, a top surface, a backside, a narrow sole, a wide wold, a toe, a heel, an alignment mark, a hole in said top surface to affix said shaft and a rectangular cross-sectional area contained within said head;

said golf putter head formed of at least one material and having a body member defining said face in a substantially vertical plane with said putter in an operative position, said face facing left of a right handed operator, said face being used as a golf ball striking surface and defining the front foremost boundary of said head, said face having an uppermost edge and a lower edge and a positive loft of at least one degree, said face being flat and slanted rearwardly adjacent said uppermost edge and forwardmost adjacent said lower edge;

said top surface being generally flat and rectangular with a front and a back and defining a surface in a substantially horizontal plane with said head is in an operative position, said top surface being essentially perpendicular to said vertical face, said heel being the boundary of said head closest to a golfer and said toe being the boundary of said head furthest from a golfer, said hole for receiving said shaft being slightly off-center toward said heel of said top surface, said top surface forming a rectangular shape from adjacent said face toward said backside and longest from said heel to said toe, said alignment mark being generally centered between said heel and said toe, said alignment mark being perpendicular to said top edge of said face and positioned coincident with and directly in line with the center of percussion of said head;

said backside forming an angular surface connecting the rearmost boundary of said top surface to a lower boundary of said face and forming an end view shape that is right triangular when viewed straight way from said heel to said toe, said angular surface forming an angle with a vertical plane, an uppermost boundary of said angular backside joining a rearmost boundary of said top surface and forming a narrow edge across the back of said top surface from said heel to said toe, a lower boundary of said backside joining the lower boundary of said face and also forming a narrow lower boundary across the lower edge of said face from said heel to said toe, said narrow lower boundary defining said narrow sole, said narrow sole being made wider by use of said wide sole being positioned adjacent the lower boundary of said backside, said wide sole being no longer than 2 inches long when measured from said toe toward said heel, said wide sole as measured from said face to said rearmost boundary being less than the width of said top surface from said face to said rearmost boundary of said top surface, said wide sole being generally centered between said heel and said toe, said wide sole having a bottom surface aligned with a lowermost boundary of said narrow sole, said bottom of said wide sole extending rearwardly in substantially a horizontal plane and being essentially perpendicular to said face, said wide sole being at least as light in weight as the lightest material contained in said head, said wide sole not being visible to a golfer in an operative position just prior to striking a golf ball;

said rectangular cross-sectional area in said head being located upwardly and forwardly into the apex of the right angle formed by said face and said top surface, said rectangular cross-sectional area being dimensionally formed by both one half the height of said face as measured in a vertical direction from said top surface to said narrow sole and one half the width of said top surface as measured from said face to said backside, two opposite sides of said rectangular cross-sectional area being dimensionally equal in size, said rectangular cross-sectional area being 100 percent filled with material from said head to said toe, said material filling said rectangular cross-sectional area being at least as heavy as other material present in said head, whereby, the weight distribution of said head is such that said head is increasingly heavier forwardly toward said face and increasingly heavier upwardly toward said top surface.

2. A golf putter as recited in claim 1 wherein the diagonal angle of said angular surface of said backside with respect to a vertical plane is between 35 to 70 degrees.

3. A golf putter as recited in claim 1 wherein the total weight in said rectangular cross-sectional area from said heel to said toe is at least 40 percent of the total weight of the head.

4. A golf putter as recited in claim 1 wherein the ratio between the increasingly heavier weight upwardly toward said top surface and the total weight of said head is at least equal to the ratio between the increasingly heavier weight forwardly toward said face.

5. A golf putter as recited in claim 1 wherein said rectangular cross-sectional area includes at least one void.

6. A golf putter as recited in claim 1 wherein said shaft is secured on said top surface from 3/16 to ½ inch off center toward said heel, said head having zero to 1½ times more weight contained in said toe area than in said heel area whereby said center of percussion is positioned centrally between said heel and said toe, said alignment mark being essentially located over the horizontal centerline of said head.

* * * * *